US005366092A

United States Patent [19]

Schmidt, Sr.

[11] Patent Number: 5,366,092

[45] Date of Patent: Nov. 22, 1994

[54] SEPARATION OF VALUABLE MINERALS FROM MATERIAL FOUND IN THE BEDS OF BODIES OF WATER

[76] Inventor: Howard M. Schmidt, Sr., 1503 Graham Rd., Venice, Sarasota County, Fla. 34293

[21] Appl. No.: 53,909

[22] Filed: Jul. 27, 1993

Related U.S. Application Data

[63] Continuation-in-part of Ser. No. 879,309, May 7, 1992, abandoned.

[51] Int. Cl.[5] ..... B03B 5/66; B03B 7/00

[52] U.S. Cl. ..... 209/17; 209/159; 209/208; 209/461

[58] Field of Search ..... 209/12.1, 17, 155, 156, 209/158, 159, 208, 455, 461

[56] References Cited

U.S. PATENT DOCUMENTS

| | | | |
|---|---|---|---|
| 482,241 | 9/1892 | Gates | 209/158 |
| 727,974 | 5/1903 | Klein | 209/159 X |
| 1,441,571 | 1/1923 | France | 209/155 |
| 1,637,625 | 8/1927 | Shaw | 209/158 |
| 1,699,962 | 1/1929 | France | 209/158 X |
| 1,865,167 | 6/1932 | Bongera | 209/158 X |
| 2,065,967 | 12/1936 | Clark et al. | 209/155 |
| 2,165,152 | 7/1939 | Pruss et al. | 209/158 |
| 3,291,304 | 12/1966 | Fuchs | 209/155 |

FOREIGN PATENT DOCUMENTS

| | | | |
|---|---|---|---|
| 1312791 | 1/1962 | France | 209/158 |

OTHER PUBLICATIONS

1990 Keene Engineering Full Line Catalog (pp. 5, 29 and 30).

*Primary Examiner*—D. Glenn Dayoan
*Assistant Examiner*—Tuan N. Nguyen
*Attorney, Agent, or Firm*—Pettis & McDonald

[57] ABSTRACT

A device for removal of solid materials from the beds of bodies of water and the separation and capture of materials having a relatively high specific gravity from lighter solid material. The device is particularly suitable for the extraction of gold from alluvial material. The device is small and lightweight and generally comprises a pipe having an open inlet end and an open outlet end. The pipe has a first opening and a second opening that communicate with a container attached to the pipe. A suction force is applied along the length of the pipe so that water and materials from the bed of the body of water enter the pipe. That material having a relatively high specific gravity is collected within the container.

17 Claims, 3 Drawing Sheets

SEPARATION OF VALUABLE MINERALS FROM MATERIAL FOUND IN THE BEDS OF BODIES OF WATER

RELATED APPLICATION

This application is a continuation-in-part of my presently co-pending application Ser. No. 07/879,309 filed May 7, 1992, now abandoned.

BACKGROUND OF THE INVENTION

1. Field of the Invention

The present invention relates to a material classification device that removes solid material and fluid from the beds of bodies of water and then separates a portion of those entrained solid materials from the fluid. The device is particularly suitable for the extraction of gold from alluvial material. The device, being small and lightweight, is suitable for use by a single individual either above or below the water surface.

2. Description of the Prior Art

Many devices have been used over the years to separate materials that have a relatively high specific gravity from lighter materials. Sluice boxes, similar to that disclosed by the patent to George Gates, U.S. Pat. No. 482,241 are well known. Many of these devices contain various sieving and screening methods to classify the materials.

Frequently dredges are used to vacuum up material from the bottoms of rivers and lakes, which material is then processed by large sluice boxes in which the fluid and material are passed over classifier screens to separate the heavier solids from the other solid material. Some classifier devices use ribbed constructions within the sluice box to capture the smaller relatively heavy particles.

U.S. Pat. No. 1,637,625, issued to E. Shaw, discloses another type of device that is used to clean and classify sand particles. The device uses a series of chambers to collect various sized particles.

Notwithstanding the current art, it remains clear that there is a need for light weight devices that can be used by an individual to dredge material from the bottoms of streams, lakes, or other bodies of water, and then separate and capture the heavier desirable solid materials simultaneously with the dredging operation. A device that has an enclosed capture system would permit working above or below the surface of the body of water.

SUMMARY OF THE INVENTION

The present invention relates to a device that vacuums materials and fluids from the beds of bodies of water, separates a portion of the entrained solid materials from the stream of fluid and returns the remainder to the body of water. The device is particularly suitable for the removal of materials that have a relatively high specific gravity, such as gold. The device comprises a pipe having an open inlet end and an open outlet end. The pipe further comprises a mid portion, an inlet portion that includes the inlet end, and an outlet portion that includes the outlet end. Two openings are formed through the wall of the mid portion of the pipe. A hollow body, or container, having a bottom, at least one side, and an open top is attached to the pipe so that the open top encompasses the two openings. Thus, the interior of the pipe is in fluid flow communication with the interior of the container through each of the openings.

A suction means is attached to the pipe in order to provide suction at the inlet end so that fluid and materials may be drawn from the bottom surface of the body of water and into the inlet end of the pipe. A portion of the stream of fluid and material passes through the mid portion of the pipe and out the outlet end. The heavier material traveling along the bottom of the interior of the pipe passes through the first opening and into the container. As the fluid passes into the container, the materials with the relatively high specific gravity migrate to the bottom of the container and the lighter materials remain entrained in the water and are carried out of the container through the second opening. These lighter materials and fluid then exit the device through the outlet end. The captured material may then be removed from the container for further examination.

The invention accordingly comprises an article of manufacture possessing the features, properties, and the relation of elements which will be exemplified in the article hereinafter described, and the scope of the invention will be indicated in the claims.

BRIEF DESCRIPTION OF THE DRAWINGS

For a fuller understanding of the nature and objects of the invention, reference should be had to the following detailed description taken in connection with the accompanying drawings, in which.

Similar reference characters refer to similar parts throughout the several views of the drawings.

DETAILED DESCRIPTION

Figure 1:
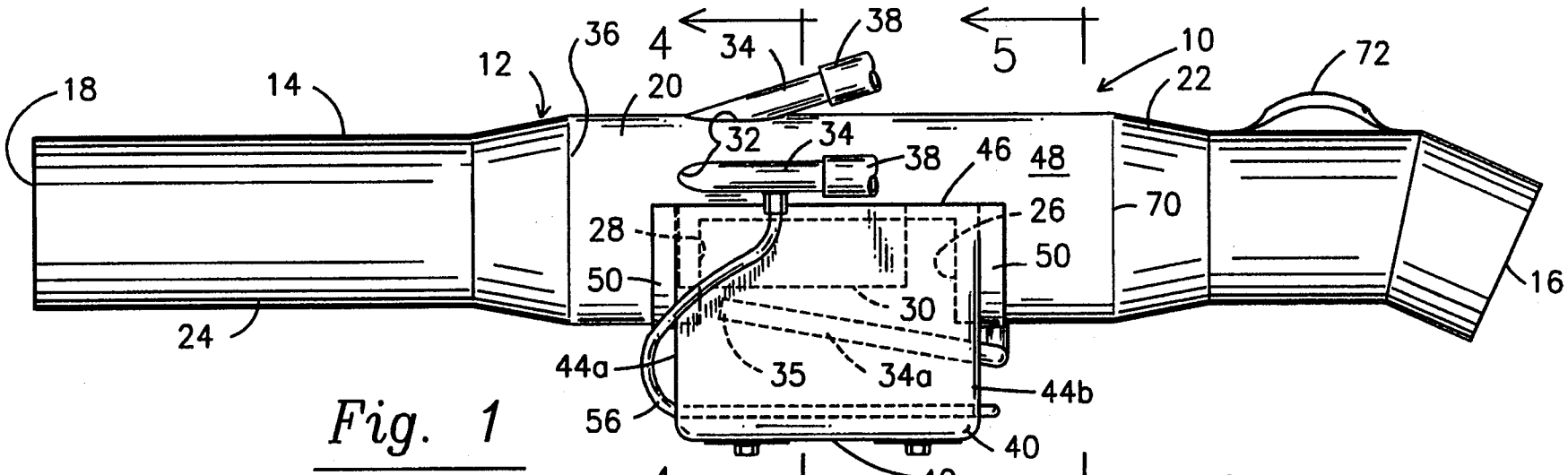
FIG. 1 is a front side elevation of a preferred embodiment of the device.
Figure 2:
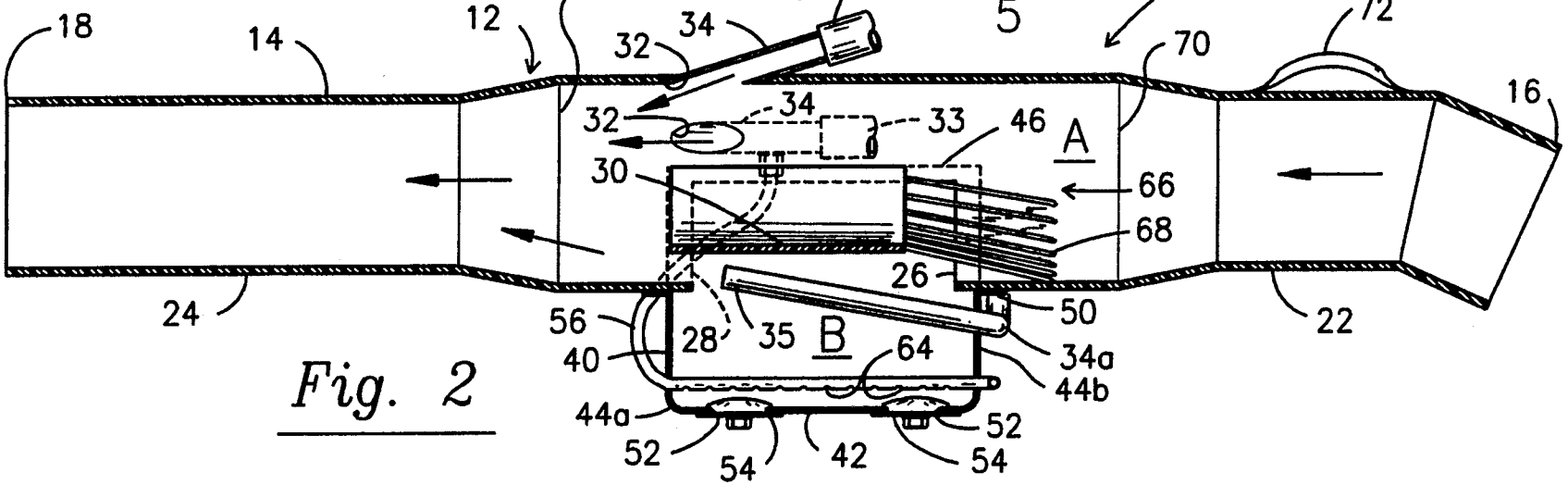
FIG. 2 is a sectional front side elevation of the device of FIG. 1.
Figure 3:
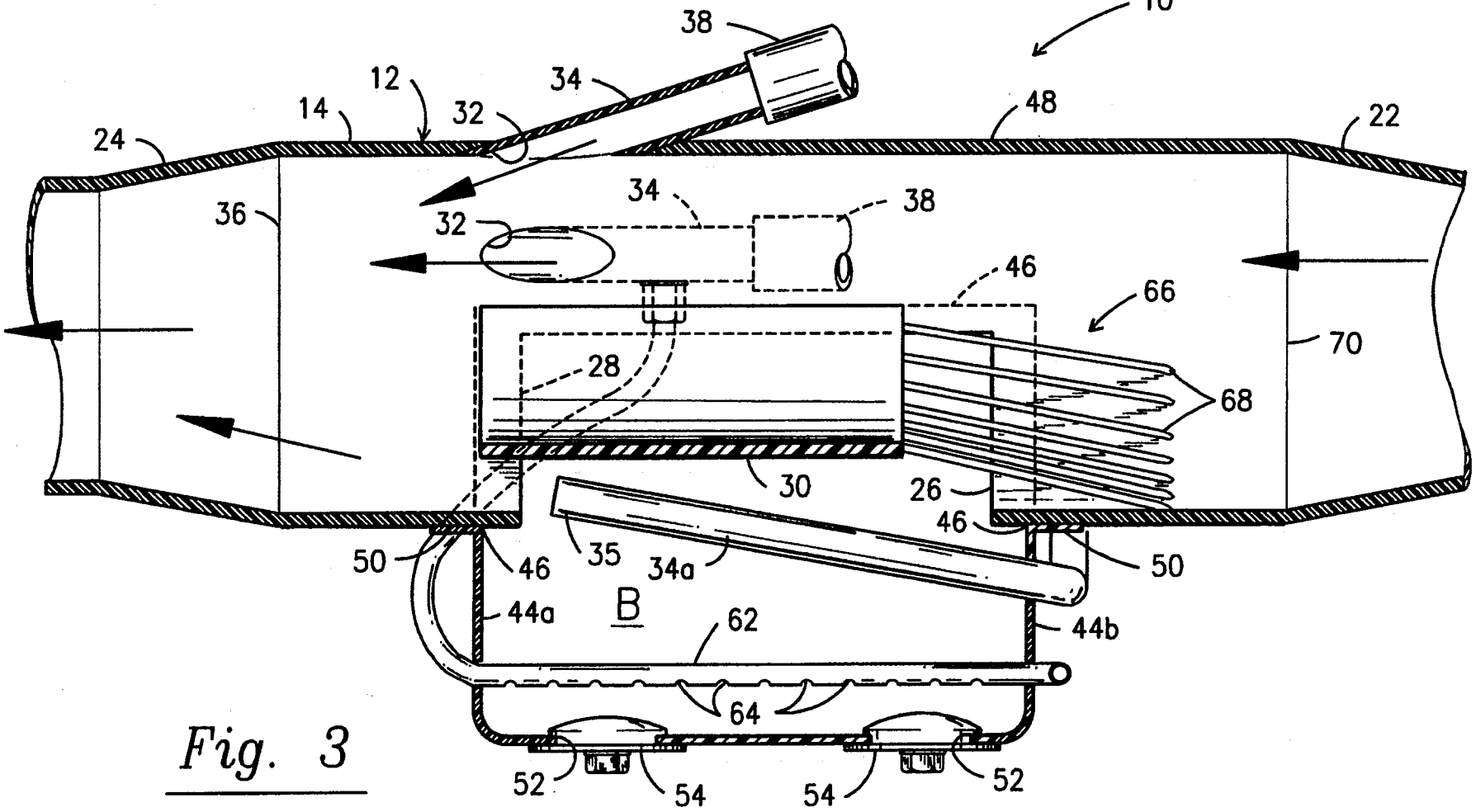
FIG. 3 is a detailed view of a portion of the sectional view of FIG. 2.

A preferred embodiment of the device is illustrated in the drawing figures, and is indicated as 10 in the views of FIGS. 1–5. Referring first to the view of FIG. 1, it can be seen that the device 10 comprises a pipe shown generally as 12 that further comprises a wall 14, as seen in FIG. 2, an open inlet end 16 and an open outlet end 18. The pipe 12 may be viewed as having three portions; a mid portion 20, an inlet portion 22 including the inlet end 16, and an outlet portion 24 that includes the outlet end 18, even though these portions may be formed as a unitary structure. The pipe 12 further comprises a first opening 26 and a second opening 28 through the wall 14 in the mid portion 20. In the preferred embodiment, an offset 30 is formed in the wall 14 of pipe 12 to enlarge the first opening 26 and the second opening 28, which can best be seen in FIG. 3. The offset 30 also shows clearly in FIGS. 4 and 5, providing opening 28 in FIG. 4 and opening 26 in FIG. 5 with the appearance a crescent shape.

A suction means is attached to pipe 12 so that a suction force may be applied inwardly at the inlet end 16 of the pipe 12. Such a suction force may be created by bringing a fluid into the device 10 through at least one hole 32 in the wall 14 of the pipe 12. In a preferred embodiment, a conduit 34 is attached, in fluid flow communication, to each one of three holes 32. A fourth conduit 34*a* is attached to pipe 12 and extends to a point adjacent to the second opening 28 so that the fluid flows through the second opening 28 and into the interior A of pipe 12. The holes 32 and the end 35 of conduit 34*a* are generally evenly spaced about the circumference of the mid portion 20 of the pipe 12 and proximal to the juncture 36 between the mid portion 20 and the outlet portion 24. Each of the conduits 34 and 34*a* is then connected to a pump means (not shown) by a hose 38. Water, air, or other fluid may then be pumped under pressure through the conduits 34 and 34*a* into the device 10 and directly out the outlet end 18, creating a suction force at the inlet end 16. While a preferred embodiment utilizes four conduits to provide an even flow, a single conduit 34, or any other number of conduits may be used with satisfactory results. In another embodiment, suction may be provided by attaching a suction hose directly to the outlet end 18.

Figure 5:
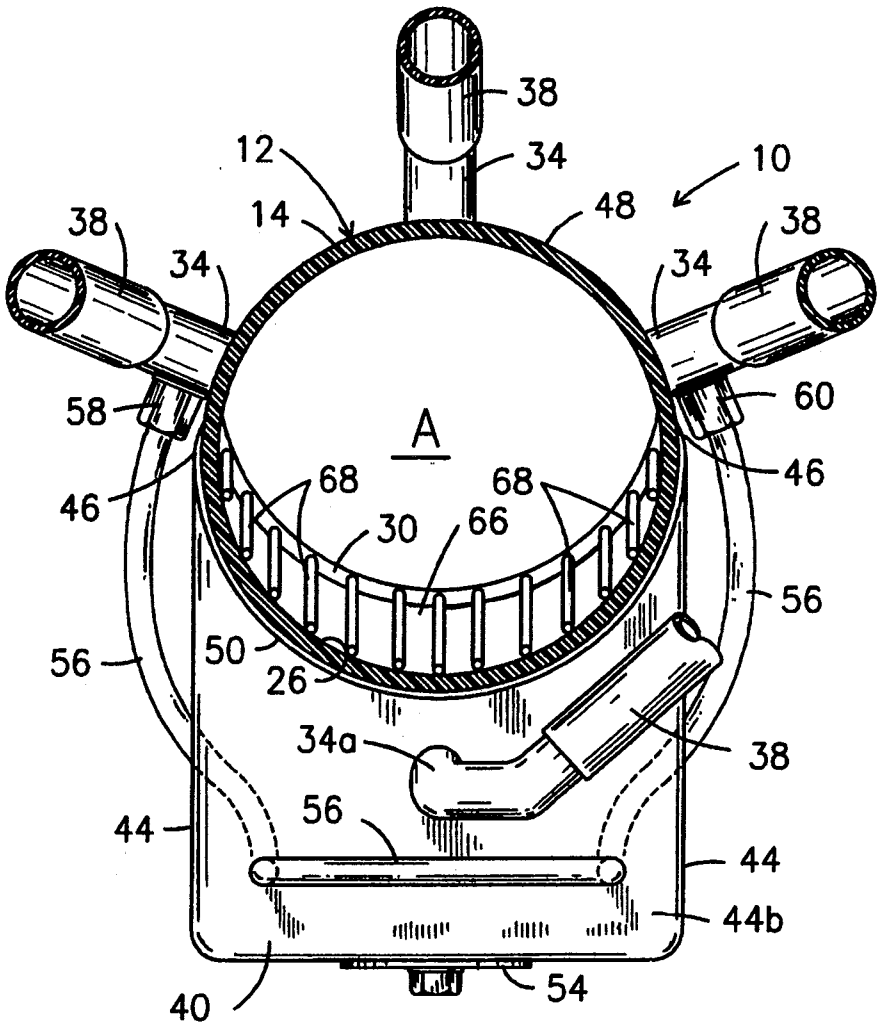
FIG. 5 is a sectional view taken along line 5—5 of FIG. 1.
Figure 4:
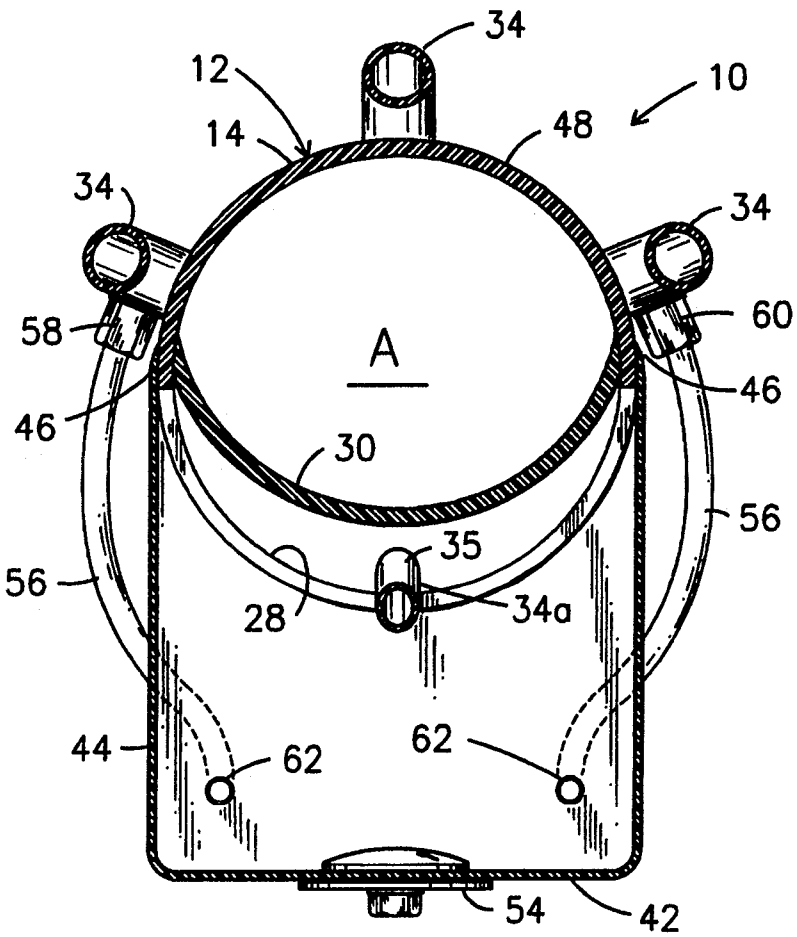
FIG. 4 is a sectional view taken along line 4—4 of FIG. 1.

A hollow body, conveniently a container 40, is formed with a bottom 42, at least one side 44, and an open top 46. The container 40 is sized and configured so that the open top 46 may be attached to the exterior surface 48 of the pipe 12 so that the first opening 26 and second opening 28 are entirely enclosed by container 40. Therefore, the interior A of the pipe is in fluid flow communication through each of the openings 26 and 28 with the interior B of the container 40. As can be seen in FIGS. 4 and 5, a portion of the open top 46 of container 40 is attached to the pipe 12 so that approximately one half the circumference of pipe 12 is enclosed by the container 40. In a preferred embodiment, a flange 50 is formed about a portion of the open top 46 of the container 40 so that a tight seal may be maintained between the container 40 and the exterior surface 48 of pipe 12. In a preferred embodiment, the container 40 is glued and sealed to the pipe surface 48; however, a sufficiently tight seal may be obtained by strapping the container 40 to the pipe 12 or by other well known attaching means. The container 40 has at least one port 52 through the bottom 42 of the container 40 for removal of the captured materials from the container 40. A means for closing and opening port 52 is attached to the container 40, conveniently removable plug 54. In a preferred embodiment, two ports 52 and their respective plugs 54 are provided for more rapid removal of the captured material. The plug 54 is an expandable rubber or elastomer plug; however, any suitable means well known in the art may be used to provide a means for closing and opening port 52.

The device 10 further comprises a means for agitating the fluid and the entrained solid materials trapped within the container 40 to encourage the separation of the lighter material from the heavier material. In a preferred embodiment, the agitation means comprises a tube 56 having a first end 58 and a second end 60 which can best be seen in FIG. 5. End 58 and end 60 are each attached to a respective conduit 34. The tube 56 intermediate first end 58 and second end 60 is routed so that the tube 56 passes through one side 44*a* of container 40, through the container 40 and out the opposing side 44*b*. The tube 56 is then curved back upon itself and passes again through side 44*b* through the container 40 and out the opposing side 44*a*, as more clearly seen in FIGS. 3 and 5. This provides two generally parallel sections 62 of the tube 56, as seen in FIG. 4, that are disposed within the container 40. The sections 62 are generally spaced apart from the bottom 42 of the container 40 and spaced apart from one another. Each of these sections 62 has a plurality of apertures 64 that open generally toward the bottom 42 of the container 40. The tube 56 is now in fluid flow communication with each conduit 34 and the apertures 64 so that fluid under pressure may enter the interior B of the container 40. When water is being pumped through conduits 34, water will, of course, be the agitation agent. However, conduits 34 may be attached to a separate pump to provide air as the agitation agent if desired. This is a preferred agitation means; however, a single tube may be used or any other well known means for agitation may be provided, including, but not limited to, mechanical agitators.

The device 10 further comprises a means for excluding large pieces of the entrained solid materials from entering the container 40 through the first opening 26. In the preferred embodiment, a screen 66 is extended across the first opening 26 and attached to the wall 14 of the pipe 12. The screen 66 may comprise a plurality of longitudinal members and cross members (not shown) or as in the preferred embodiment, a plurality of longitudinally oriented longitudinal members 68, commonly called a grizzly. The spacing between the members 68 is determined by the maximum size materials that the operator wishes to capture within the container 40.

In the preferred embodiment, in order to slow the flow of water and entrained materials as they approach the first opening 26, the pipe 12 is enlarged. The mid portion 20 that is intermediate first opening 26 and the juncture 70, between the mid portion 20 and inlet portion 22, has a greater circumference than the inlet portion 22. Also, the mid portion 20 that is intermediate the second opening 28 and the juncture 36, of the mid portion 20 and the outlet portion 24, has a greater circumference than the outlet portion 24.

The device 10 in a preferred embodiment is constructed of a generally rigid synthetic resin; however, the pipe 12, container 40, conduits 34 and tube 56 may be constructed of any suitable lightweight material that is well known in the art. The screen 66 is generally constructed of metal, but may also be constructed of a synthetic resin having suitable strength characteristics.

Having thus set forth a preferred construction for the device 10 of this invention, it is to be remembered that this is but a preferred embodiment. Attention is now invited to a description of the use of the device 10.

The device 10 is lightweight and portable so that it may be handled by a single individual. A handle 72 is provided proximal to the inlet end 16 for ease of handling during operation. A pump (not shown) is provided on the shore of the body of water being excavated, or it may be floated on a platform near the operator of the device 10. The pump is connected by hoses 38 to the conduits 34 and 34*a*. In a preferred embodiment, water is used as the fluid for obtaining a suction force at the inlet end 16. However, the operator may utilize a pump which provides air to the device 10. As water normally is the preferable fluid, the operation of device 10 will be described as utilizing water.

When the operator is in position, the pump is started and water is pumped through the hoses 38, through the conduits 34 and 34*a*, into the pipe 12, and out the outlet end 18. This flow of water creates a suction at the open inlet end 16. At the same time, a portion of the fluid will flow from the conduit 34, through the tube 56, and out the apertures 64 into the container 40. The operator then places the inlet end 16 adjacent the bottom area of the body of water from which the materials are to be removed. The water and entrained solid materials are sucked into the inlet end 16. The materials that have a relatively high specific gravity move along the bottom of pipe 12. When the solid materials engage the screen 66, the larger particles and a portion of the lighter solid are carried upward through the mid portion 20 of the pipe and then out the outlet end 18. The smaller particles of the solid material pass through the screen 66 and enter the container 40. A mixture of heavier and lighter particles are captured within container 40; therefore, agitation is desirable to separate further the lighter particles from those with a heavier specific gravity. The entry of water through the apertures 64 produces a state of liquefaction separating the lighter materials from those with a higher specific gravity that then migrate to the bottom 42 of the container 40. The lighter materials are carried by the flow of water outward through the second opening 28 and out the outlet end 18. The pressure of the water will be regulated so that there is insufficient flow rate to remove those materials with a high specific gravity, therefore, they will accumulate within the container 40. When the container is full, the plugs 54 may be removed and the material extracted through ports 52 for further processing.

During operation of the device 10, in a moving stream the longitudinal axis of the device 10 may be inclined with the bottom surface in a downstream direction to form an angle as great as 40° and still maintain efficient separation of the materials. When the device is normal to the current, the device should not be inclined at greater than 20° with the bottom. This will vary depending on the speed of the current. Since the container is enclosed, the device may be operated below the surface of the body of water being excavated.

It will thus be seen that the objects set forth above, among those made apparent from the preceding description, are efficiently attained and, since certain changes may be made in the above article without departing from the scope of the invention, is intended that all matter contained in the above description, or shown in the accompanying drawings, shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A device for separating a portion of entrained solid materials from a stream of fluid of the type primarily for use in combination with a pump, said device comprising:

a pipe comprising a wall, an open inlet end, an open outlet end and an interior, said wall having a first opening and a second opening therethrough, and said pipe further comprising a mid portion, an inlet portion including said inlet end, and an outlet portion including said outlet end;

a container comprising a hollow body having an interior, a bottom, at least one side, and an open top, said open top being attached to said pipe such that said interior of said pipe is in fluid flow communication with said interior of said container through each of said first and second openings;

a suction means attached to said pipe providing suction at said inlet end, whereby the fluid and the materials are drawn into said inlet end of said pipe, a portion of the stream of fluid and material passing through said mid portion of said pipe and out said outlet end, and the remaining portion of the stream of fluid and material passing through said first opening, a portion of the material being captured in said container and the remaining portion of the fluid and material passing through said second opening and out said outlet end; and an agitation means comprising at least one tube having a first end and a second end, said first end of said tube passing through said side of said container so that at least a portion of said tube extends into said container, said tube being spaced apart from said bottom of said container, said portion of said tube within said container having at least one aperture therein, and said second end of said tube being adapted for connection to a pump means whereby fluid is pumped through said aperture to agitate the materials captured in said container.

2. A device as in claim 1 wherein a portion of said wall of said pipe that is intermediate said first opening and said second opening is offset inwardly in relation to said pipe interior.

3. A device as in claim 1 wherein said apertures open generally toward said bottom of said container.

4. A device as in claim 1 wherein said suction means comprises:

at least one hole in said wall of said device;

a hose having a first end and a second end, said first end being attached to said hole such that said hose is in fluid flow communication with said interior of said pipe, said second end of said hose adapted for connection to a pump means, and wherein said agitation means comprises a first tube and a second tube each having first and second ends, said first end of each one of said tubes being connected in fluid flow communication with said hose, said second end of each one of said tubes extending through a portion of said side of said container and through an opposing portion of said side, said second ends then being joined to one another in fluid flow communication, said tubes being spaced apart from one another and from said bottom of said container, and said portion of each said tube intermediate said opposing portions of said side of said container having at least one aperture therein.

5. A device as in claim 4 wherein said apertures open generally toward said bottom of said container.

6. A device as in claim 1 wherein said suction means comprises:

at least one hole in said wall of said device;

a hose having a first end and a second end, said first end being attached to said hole such that said hose is in fluid flow communication with said interior of said pipe, said second end of said hose adapted for connection to a pump means whereby fluid is pumped under pressure into said pipe and out said outlet end.

7. A device as in claim 1 wherein said device further comprises: a means for excluding a portion of said material from entering said container.

8. A device as in claim 7 wherein said means for excluding comprises a screen extending across said first opening in said pipe.

9. A device as in claim 1 wherein a circumference of said mid portion of said pipe intermediate said first opening and said inlet portion of said pipe is greater than a circumference of said inlet portion of said pipe.

10. A device as in claim 1 wherein a circumference of said mid portion of said pipe intermediate said second opening and said outlet portion is greater than the circumference of said outlet portion of said pipe.

11. A device as in claim 1 wherein said container further comprises at least one port through said bottom of said container and a means for closing and opening said port removably attachable to said container.

12. (Amended) A device for separating a portion of entrained solid materials from a stream of fluid of the type primarily for use in combination with a pump, said device comprising:

a pipe comprising a wall, an open inlet end, an open outlet end and an interior, said wall having a first opening and a second opening therethrough, and said pipe further comprising a mid portion, an inlet portion including said inlet end, and an outlet portion including said outlet end, a portion of said wall of said pipe that is intermediate said first opening and said second opening being offset inwardly in relation to said pipe interior such that said intermediate portion of said pipe defines a reduced circumference;

a container comprising a hollow body having an interior, a bottom, at least one side, and an open top, said open top being attached to said pipe such that said interior of said pipe is in fluid flow communication with said interior of said container through each of said first and second openings; and a suction means attached to said pipe providing suction at said inlet end, whereby the fluid and the materials are drawn into said inlet end of said pipe, a portion of the stream of fluid and material passing through said mid portion of said pipe and out said outlet end, and the remaining portion of the stream of fluid and material passing through said first opening, a portion of the material being captured in said container and the remaining portion of the fluid and material passing through said second opening and out said outlet end.

13. A device as in claim 12 further comprising at least one tube having a first end and a second end, said first end of said tube passing through said side of said container so that at least a portion of said tube extends into said container, said tube being spaced apart from said bottom of said container, said portion of said tube within said container having at least one aperture therein, and said second end of said tube being adapted for connection to a pump means, whereby fluid is pumped through said aperture to agitate the materials captured in said container.

14. A device as in claim 13 wherein said apertures open generally toward said bottom of said container.

15. A device as in claim 12 wherein said suction means comprises;

at least one hole in said wall of said device;

a hose having a first end and a second end, said first end being attached to said hole such that said hose is in fluid flow communication with said interior of said pipe, said second end of said hose adapted for connection to a pump means, whereby fluid is pumped under pressure into said pipe and out said outlet end.

16. A device as in claim 12 wherein a circumference of said mid portion of said pipe intermediate said first opening and said inlet portion of said pipe is greater than a circumference of said inlet portion of said pipe.

17. A device as in claim 12 wherein a circumference of said mid portion of said pipe intermediate said second opening and said outlet portion is greater than the circumference of said outlet portion of said pipe.

* * * * *

UNITED STATES PATENT AND TRADEMARK OFFICE

CERTIFICATE OF CORRECTION

PATENT NO. : 5,366,092

DATED : November 22, 1994

INVENTOR(S) : Howard M. Schmidt, Sr.

It is certified that error appears in the above-identified patent and that said Letters Patent is hereby corrected as shown below:

Column 7, claim 12, line 11, delete "(Amended)"

Signed and Sealed this

Thirty-first Day of January, 1995

*Attest:*

Bruce Lehman

BRUCE LEHMAN

*Attesting Officer*

*Commissioner of Patents and Trademarks*